US009677426B2

(12) United States Patent
Becker

(10) Patent No.: US 9,677,426 B2
(45) Date of Patent: Jun. 13, 2017

(54) EXHAUST-GAS TURBOCHARGER

(71) Applicant: BorgWarner Inc., Auburn Hills, MI (US)

(72) Inventor: Martin Becker, Malsch (DE)

(73) Assignee: BorgWarner Inc., Auburn Hills, MI (US)

( * ) Notice: Subject to any disclaimer, the term of this patent is extended or adjusted under 35 U.S.C. 154(b) by 436 days.

(21) Appl. No.: 14/375,484

(22) PCT Filed: Feb. 11, 2013

(86) PCT No.: PCT/US2013/025496
§ 371 (c)(1),
(2) Date: Jul. 30, 2014

(87) PCT Pub. No.: WO2013/122851
PCT Pub. Date: Aug. 22, 2013

(65) Prior Publication Data

US 2014/0363285 A1 Dec. 11, 2014

(30) Foreign Application Priority Data

Feb. 14, 2012 (DE) ..... 10 2012 002 886

(51) Int. Cl.
*F01D 25/24* (2006.01)
*F01D 5/06* (2006.01)

(52) U.S. Cl.
CPC ..... *F01D 25/243* (2013.01); *F01D 5/066* (2013.01); *F05D 2220/40* (2013.01);
(Continued)

(58) Field of Classification Search
CPC ..... F01D 25/243; F01D 5/066; F01D 25/16; F01D 25/24; F05D 2240/00;
(Continued)

(56) References Cited

U.S. PATENT DOCUMENTS 1,434,433 A * 11/1922 Ettinger ..... B27C 5/00 403/239
3,700,292 A * 10/1972 Owens ..... B23Q 1/0063 384/9

(Continued)

FOREIGN PATENT DOCUMENTS

JP 10-238519 A 9/1998
JP WO 2012081491 A1 * 6/2012 ..... F01D 11/003

(Continued)

OTHER PUBLICATIONS

International Search Report in International Application No. PCT/US2013/025496, dated Jun. 24, 2013.

*Primary Examiner* — Craig Kim
*Assistant Examiner* — Eldon Brockman
(74) *Attorney, Agent, or Firm* — Eric L. Doyle; Stephan A. Pendorf; Patent Central LLC

(57) ABSTRACT

An exhaust-gas turbocharger (1) having a compressor (2), which has a compressor housing (3); a turbine (4), which has a turbine housing (5): and a bearing housing (6), which is arranged between the compressor housing (3) and the turbine housing (5) and is connected to the compressor housing (3) by way of a compressor-side connecting device and to the turbine housing (5) by way of a turbine-side connecting device (7). The turbine housing-side and/or compressor-side connecting device (7) is in the form of a taper key bolted joint having bolts (8, 9, 10) which are arranged at least substantially perpendicularly to an exhaust-gas turbocharger longitudinal axis (L).

6 Claims, 4 Drawing Sheets

Figure 1:
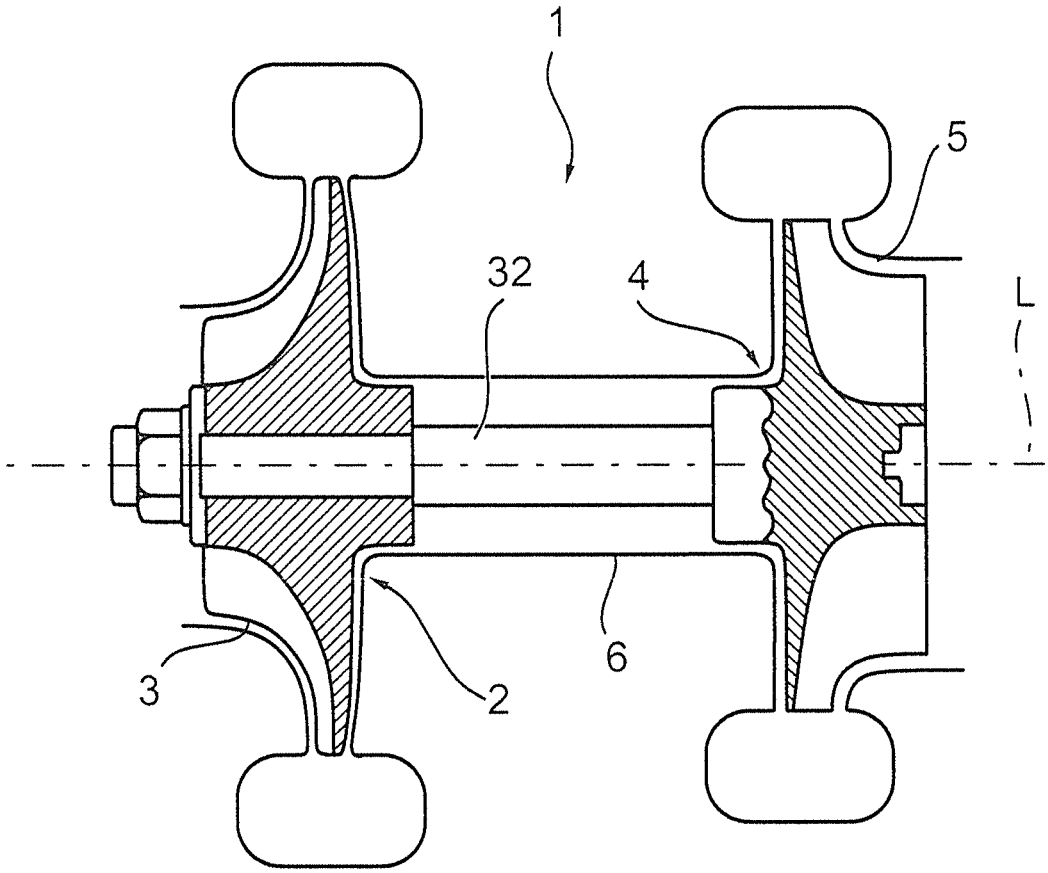

(52) U.S. Cl.
CPC .... *F05D 2240/00* (2013.01); *F05D 2250/192* (2013.01); *F05D 2260/31* (2013.01)

(58) Field of Classification Search
CPC ..... F05D 2220/40; F05D 2250/192; F05D 2260/31; F05D 2300/502; F02B 39/00; F02C 6/12; F02C 7/24; F05B 2260/301
See application file for complete search history.

(56) References Cited

U.S. PATENT DOCUMENTS

| | | | | | |
|---|---|---|---|---|---|
| 4,146,261 | A * | 3/1979 | Edmaier | F01D 25/243 | 285/364 |
| 5,465,482 | A * | 11/1995 | Elvekjaer | F01D 25/24 | 29/401.1 |
| 5,513,547 | A * | 5/1996 | Lovelace | B23Q 3/186 | 29/271 |
| 7,008,182 | B2 * | 3/2006 | Kopp | F01D 9/026 | 415/136 |
| 7,797,936 | B2 * | 9/2010 | Hayashi | F01D 25/16 | 411/395 |
| 2009/0151348 | A1 * | 6/2009 | Hayashi | F01D 25/16 | 60/598 |
| 2012/0227398 | A1 * | 9/2012 | Uhlig | F01D 25/243 | 60/605.1 |
| 2013/0129502 | A1 * | 5/2013 | Schaefer | F01D 25/243 | 415/214.1 |

FOREIGN PATENT DOCUMENTS

| | | | |
|---|---|---|---|
| KR | 20030087345 | A | 11/2003 |
| KR | 20090128577 | A | 12/2009 |
| KR | 20110068847 | A | 6/2011 |
| KR | 20110093234 | A | 8/2011 |

* cited by examiner

EXHAUST-GAS TURBOCHARGER

The invention relates to an exhaust-gas turbocharger according to the preamble of claim 1.

Bolts or stay bolts extending in the direction of the longitudinal axis of the exhaust-gas turbocharger, bolted joints on the spiral circumference of the compressor housing with long bolts, tensioning strap connections or segment bolted joints are known for connecting a turbine housing and a bearing housing of an exhaust-gas turbocharger of the generic type.

The problem with such connecting devices is often an inadequate accessibility and thus complication of the assembly.

It is an object of the present invention, therefore, to provide an exhaust-gas turbocharger of the type indicated in the preamble of claim 1 which is provided with a connecting device which is easily accessible and easy to assemble between the bearing housing and the turbine housing and/or between the bearing housing and the compressor housing.

This object is achieved by the features of claim 1.

This has the effect that the connecting device has bolts which are radially accessible in the form of a taper key bolted joint and can be inserted through a flange of the turbine housing and/or of the compressor housing and fixed.

The dependent claims relate to advantageous developments of the invention.

The taper key bolted joint of the connecting device according to the invention preferably has a number of small taper key blocks provided with an internal thread and arranged distributed on an inner circumference of the turbine/compressor housing flange which corresponds to the number of bolts. After the bolts have been inserted through the turbine housing flange or compressor housing flange, the bolts can be screwed into the small taper key blocks, with the tightening of the bolts meaning that the small taper key blocks are pulled outward, as seen radially, and in this respect preferably slide over a beveled surface arranged on the bearing housing along a complementary beveled surface formed on the small taper key block. As a result of the interaction between said beveled surfaces, a preload force is applied in the longitudinal or principal direction of the exhaust-gas turbocharger.

In one variant of the taper key bolted joint according to the invention, it is possible to press clamping elements with wedge-shaped lugs into a groove located on the turbine housing/compressor housing. A complementary beveled surface which is remote from the turbine housing/compressor housing and on which the beveled surface of the lug is supported is formed in the groove. The axial preload force is applied by the complementary beveled surfaces when the bolt is tightened.

In a further variant, the force action of the bolts is reversed. In this case, the bolts rest radially on a bearing housing wall region, as a result of which the clamping element is pushed into the groove in the turbine housing/compressor housing.

The dependent claims relate to advantageous developments of the invention.

Figure 2:
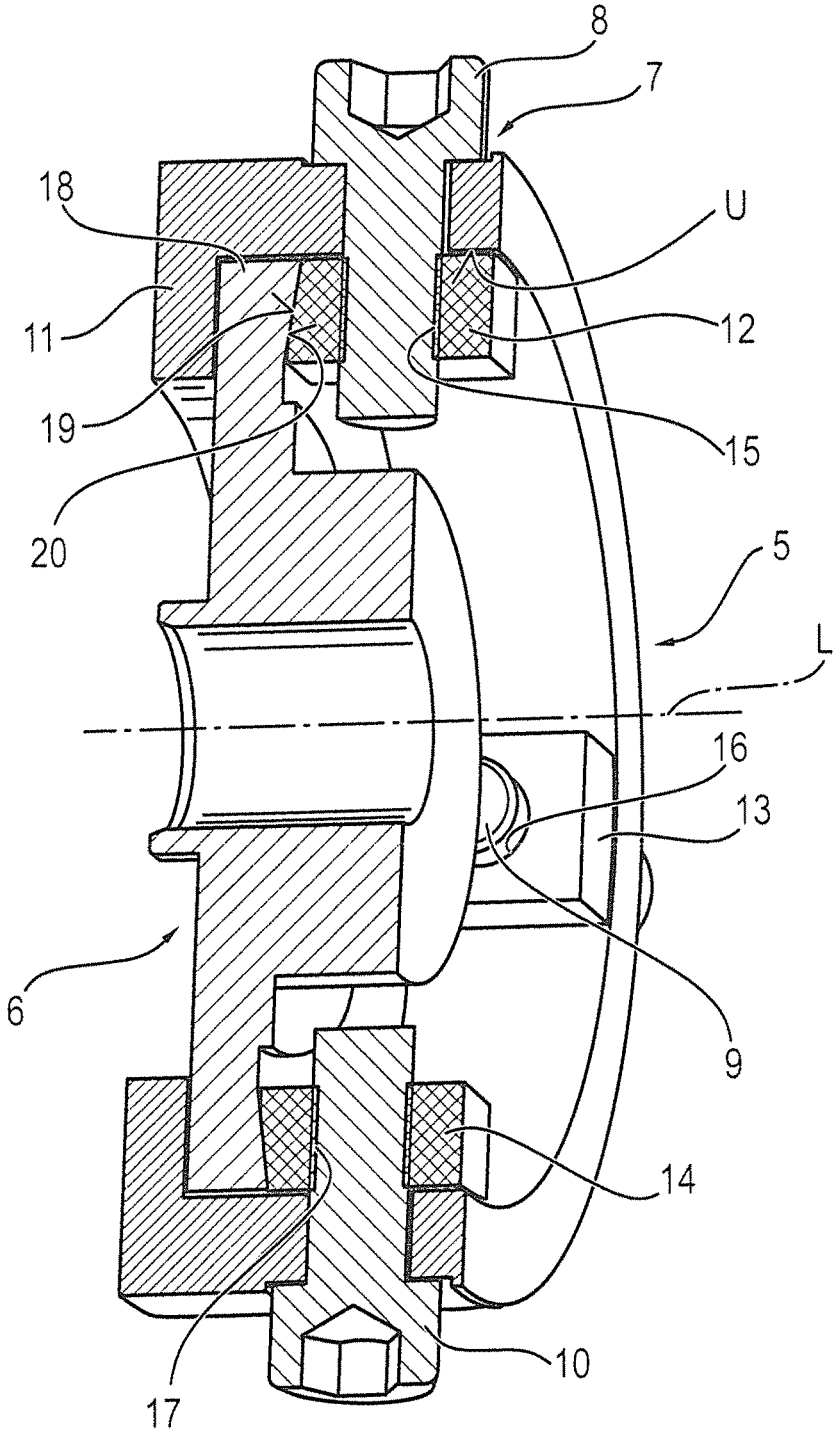
Figure 3:
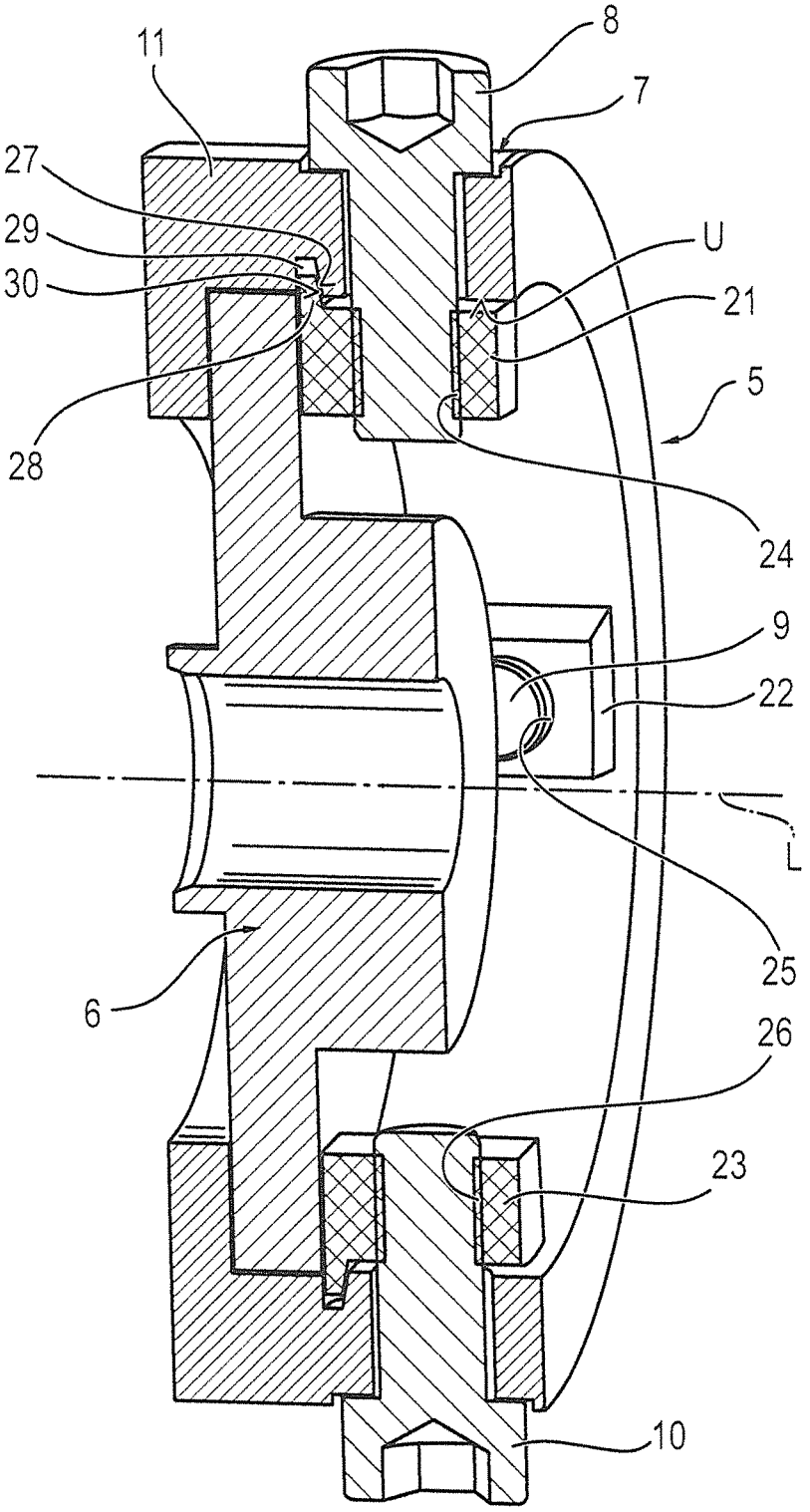
Figure 4:
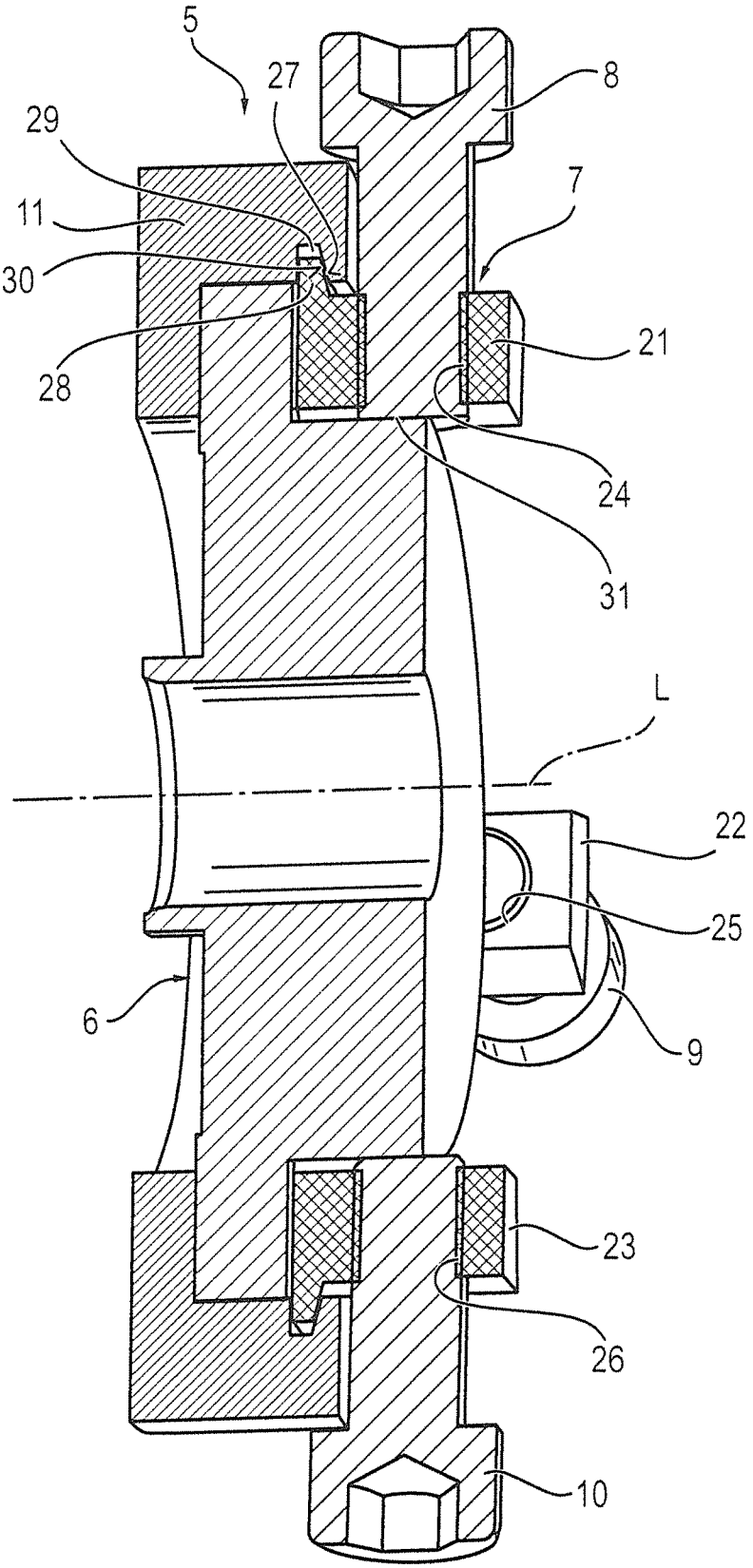

Further details, advantages and features of the present invention become apparent from the following description of exemplary embodiments with reference to the drawing, in which:

FIG. 1 shows a schematically greatly simplified illustration of an exhaust-gas turbocharger according to the invention, which can be provided with a connecting device according to the invention for connecting the bearing housing and the turbine housing, FIG. 2 shows a sectional illustration of a first embodiment of the exhaust-gas turbocharger according to the invention and of the connecting device according to the invention, FIG. 3 shows an illustration, corresponding to FIG. 2, of a second embodiment, and FIG. 4 shows an illustration, corresponding to FIGS. 2 and 3, of a third embodiment.

FIG. 1 shows, in a schematically greatly simplified illustration, an exhaust-gas turbocharger 1, which, as the usual main components, has a compressor 2 with a compressor housing 3 and a turbine 4 with a turbine housing 5.

A bearing housing 6, in which a rotor shaft 32 provided at its two ends with a compressor wheel and, respectively, a turbine wheel is mounted, is arranged between the compressor housing 3 and the turbine housing 5.

The bearing housing 6 is fastened both to the compressor housing 3 and to the turbine housing 5, a connecting device according to the invention for attaching the bearing housing 6 to the turbine housing 5 being explained in detail hereinbelow, by way of example, with reference to FIGS. 2 to 4. The connecting device according to the invention may, however, also be used on the compressor side.

FIG. 2 shows a first embodiment of a connecting device 7, which, in the example shown, has three of four bolts 8, 9 and 10, which, in the example, are arranged offset in each case by 90° in relation to one another. The bolts 8, 9 and 10 are inserted through a turbine housing flange 11 and, in the embodiment shown in FIG. 2, screwed into the internal thread 15, 16, 17 of associated small taper key blocks 12, 13 and 14.

As is apparent on the basis of the top partial connection, as per the illustration shown in FIG. 2, the small taper key blocks each have beveled surfaces 19, which rest against a complementarily formed beveled surface 20 of a bearing housing flange 18. The tightening of the bolts 8, 9 and 10 means that the associated small taper key blocks 12, 13 and 14 are pulled radially outward, in which case the beveled surfaces 19 and 20 slide on one another and therefore an axial preload force is applied in the principal direction L of the exhaust-gas turbocharger 1.

In the embodiment shown in FIG. 3, the connecting device 7 in turn has three of four bolts 8, 9 and 10, which are inserted through the turbine housing flange 11 and engage into the internal thread 24, 25 and 26 of associated clamping elements 21, 22 and 23.

The clamping elements 21, 22 and 23 each have an identical form, and therefore reference is made to the clamping element 21 as a representative of the design thereof. FIG. 3 in this respect shows that the clamping element 21 has a lug 28 provided with a beveled surface 27. The lug 28 engages into a groove 29 in the turbine housing flange 11 and in this position rests on a complementarily formed, beveled turbine housing surface 30. The tightening of the bolts 8, 9 and 10 means that the clamping elements are in turn pulled radially outward, in which case the beveled surfaces 29 and 30 sliding on one another generate the axial preload force.

In terms of the clamping elements 21, 22 and 23 with the respective lugs 28 thereof and the complementary beveled surfaces 29 and 30, the embodiment shown in FIG. 4 corresponds to that shown in FIG. 3. In the embodiment shown in FIG. 4, however, the force action of the bolts 8, 9 and 10 is reversed compared to the embodiment shown in FIG. 3, since the bolts 8, 9 and 10 rest at the end on a bearing housing wall region 31, as a result of which the clamping elements 21, 22 and 23 are pressed into the groove 29 when the bolts 8, 9 and 10 are tightened, as a result of which the axial preload force is generated.

In addition to the above written disclosure of the invention, reference is hereby explicitly made to the illustrative representation thereof in FIGS. 1 to 4.

LIST OF REFERENCE SIGNS

1 Exhaust-gas turbocharger
2 Compressor
3 Compressor housing
4 Turbine
5 Turbine housing
6 Bearing housing
7 Connecting device
8, 9, 10 Bolts
11 Turbine housing flange
12, 13, 14 Small taper key blocks
15, 16, 17 Internal thread
18 Bearing housing flange
19, 20 Beveled surfaces
21, 22, 23 Clamping elements
24, 25, 26 Thread
27 Beveled surface
28 Lug
29 Groove
30 Beveled surface
31 Bearing housing wall region
32 Rotor shaft
L Longitudinal axis or principal direction of the exhaust-gas turbocharger
U Inner circumference

The invention claimed is:

1. An exhaust-gas turbocharger (1) comprising:
a compressor (2), which has a compressor housing (3);
a turbine (4), which has a turbine housing (5), and
a bearing housing (6), which is arranged between the compressor housing (3) and the turbine housing (5) and is connected to the compressor housing (3) by way of a compressor-side connecting device and to the turbine housing (5) by way of a turbine-side connecting device (7), wherein
the turbine-side and/or compressor-side connecting device (7) is in the form of a taper key bolted joint having bolts (8, 9, 10) which are arranged at least substantially perpendicularly to an exhaust-gas turbocharger longitudinal axis (L).

2. The exhaust-gas turbocharger as claimed in claim 1, wherein the bolts (8, 9, 10) are in the form of socket bolts.

3. An exhaust-gas turbocharger (1) comprising:
a compressor (2), which has a compressor housing (3);
a turbine (4), which has a turbine housing (5), and
a bearing housing (6), which is arranged between the compressor housing (3) and the turbine housing (5) and is connected to the compressor housing (3) by way of a compressor-side connecting device and to the turbine housing (5) by way of a turbine-side connecting device (7), wherein
the turbine-side and/or compressor-side connecting device (7) is in the form of a taper key bolted joint having bolts (8, 9, 10) which are arranged at least substantially perpendicularly to an exhaust-gas turbocharger longitudinal axis (L),
wherein the taper key bolted joint (7) has a number of small taper key blocks (12, 13, 14) arranged distributed on an inner circumference (U) of a turbine housing flange (11) and/or compressor housing flange which corresponds to the number of bolts (8, 9, 10), which small taper key blocks are each provided with an internal thread (15, 16, 17).

4. The exhaust-gas turbocharger as claimed in claim 3, wherein the small taper key blocks (12, 13, 14) and a bearing housing flange (18) arranged adjacent thereto have complementary beveled surfaces (19 and 20) lying on one another.

5. An exhaust-gas turbocharger (1) comprising:
a compressor (2), which has a compressor housing (3);
a turbine (4), which has a turbine housing (5), and
a bearing housing (6), which is arranged between the compressor housing (3) and the turbine housing (5) and is connected to the compressor housing (3) by way of a compressor-side connecting device and to the turbine housing (5) by way of a turbine-side connecting device (7), wherein
the turbine-side and/or compressor-side connecting device (7) is in the form of a taper key bolted joint having bolts (8, 9, 10) which are arranged at least substantially perpendicularly to an exhaust-gas turbocharger longitudinal axis (L),
wherein the connecting device (7) has a number of clamping elements (21, 22, 23) which corresponds to the number of bolts (8, 9, 10), which clamping elements each have an internal thread (24, 25, 26) for the bolts (8, 9, 10) and each have a lug (28), which are provided with a beveled surface (27), engage into a groove (29) in the turbine housing flange (11) and/or compressor housing flange, and are provided with a turbine housing beveled surface (30) and/or compressor housing beveled surface which is remote from the turbine housing (5) or the compressor housing (3) and is formed complementarily to the beveled surface (27) of the lug (28).

6. The exhaust-gas turbocharger as claimed in claim 5, wherein the bolts (8, 9, 10) are supported radially on a bearing housing wall region (31).

* * * * *